United States Patent [19]

Toya et al.

[11] Patent Number: 4,812,391

[45] Date of Patent: Mar. 14, 1989

[54] SILVER HALIDE PHOTOGRAPHIC MATERIAL CONTAINING POLYMER FIXATION ACCELERATOR

[75] Inventors: Ichizo Toya; Tomokazu Yasuda, both of Kanagawa, Japan

[73] Assignee: Fuji Photo Film Co., Ltd., Kanagawa, Japan

[21] Appl. No.: 109,888

[22] Filed: Oct. 19, 1987

[30] Foreign Application Priority Data

Oct. 17, 1986 [JP] Japan ..... 61-247111

[51] Int. Cl.[4] ..... G03C 5/38; G03C 1/46; G03C 7/26; G03C 1/06

[52] U.S. Cl. ..... 430/564; 430/213; 430/215; 430/232; 430/455; 430/493; 430/502; 430/505; 430/548; 430/566; 430/567; 430/578; 430/609

[58] Field of Search ..... 430/213, 215, 502, 232, 430/566, 578, 505, 548, 564, 609, 567, 493, 455

[56] References Cited

U.S. PATENT DOCUMENTS

| | | | |
|---|---|---|---|
| 3,411,912 | 11/1968 | Dyksta et al. | 430/535 |
| 3,898,088 | 5/1975 | Cohen et al. | 430/213 |
| 3,958,995 | 5/1976 | Campbell et al. | 430/213 |
| 4,131,469 | 12/1978 | Miyazako et al. | 430/213 |
| 4,722,885 | 2/1988 | Yokoyama et al. | 430/548 |
| 4,745,048 | 5/1988 | Kishimoto et al. | 430/548 |

*Primary Examiner*—Mukund J. Shah

*Attorney, Agent, or Firm*—Sughrue, Mion, Zinn, Macpeak and Seas

[57] ABSTRACT

A silver halide photographic material having good granularity, high sensitivity and excellent fixability, comprising a support and at least one photosensitive silver halide emulsion layer containing silver halide grains. The silver halide grains have an average iodine content of at least 3 mole %, and the photographic material further contains a polymer capable of providing a cation site in a fixing solution on the same side as the photosensitive layer.

10 Claims, No Drawings

SILVER HALIDE PHOTOGRAPHIC MATERIAL CONTAINING POLYMER FIXATION ACCELERATOR

FIELD OF THE INVENTION

This invention relates to a silver halide photographic material, and particularly, to a silver halide photographic material having good granularity, high sensitivity and excellent fixability.

BACKGROUND OF THE INVENTION

Generally, the image quality of a silver halide photographic material is determined by sharpness and granularity. It is known that granularity is generally improved by increasing the iodine content of silver halide. Furthermore, increasing the iodine content of silver halide results in an increased efficiency of absorption of blue light. However, with increasing iodine content of the silver halide, the speed of fixation becomes drastically delayed and a problem of poor fixation arises. This leads to a marked degradation of image quality. It has been strongly desired to solve this problem.

SUMMARY OF THE INVENTION

It is an object of this invention to provide a silver halide photographic material having good granularity, high sensitivity and a fast fixing speed.

It has now been found in accordance with this invention that the above problem can be solved by a silver halide photographic material comprising a support and at least one photosensitive silver halide emulsion layer containing photosensitive silver halide having an average iodine content of at least 3 mole%, said photographic material further containing a polymer capable of providing a cation site in a fixing solution on the same side as the emulsion layer.

DETAILED DESCRIPTION OF THE INVENTION

The silver halide grains in the photographic emulsion used in the photographic material of this invention may have regularly-shaped crystals such as cubic, hexahedral, dodecahedral or tetradecahedral crystals, or irregularly-shaped crystals such as spherical or plate-like crystals, or crystals having a combination of these shapes. They may also be plate like grains having an aspect ratio of at least 5 described in Research Disclosure, Vol. 225, pages 20–58 (January, 1983).

They may also have an epitaxial structure, or they may be grains of a multilayer structure having different compositions (for example, being comprised of layers of different proportions of halogens) between the interior and the surface of the grains.

Preferably, these silver halide grains have an average size of at least 0.5 microns, more preferably 0.7 microns to 5.0 microns.

The particle size distribution may be broad or narrow. An emulsion having a narrow particle size distribution is known as a monodisperse emulsion. The grains may have a dispersion coefficient of not more than 20%, preferably not more than 15%. The dispersion coefficient, as used herein, is the quotient of the standard deviation divided by the average grain size.

These photographic emulsions may be prepared, for example, by using the methods described in P. Glafkides, *Chimie et Physique Photographique,* 1967, published by Paul Montel Company, G. F. Duffin, *Photographic Emulsion Chemistry,* 1966, published by the Focal Press, and V. L. Zelikman, *Making and Coating Photographic Emulsion,* 1964, published by The Focal Press. Specifically, any of the acidic method, the neutral method, the ammonia method, etc. may be used. The reaction of a soluble silver salt with a soluble halogen salt may be effected by a one-side mixing method, a simultaneous mixing method, or a combination of these.

These photosensitive silver halide grains may be any of silver chloride, silver bromide, silver iodide, silver iodobromide, silver chlorobromide and silver chloroiodide.

It is important that in the silver halide grains in all of the photographic emulsions used, the average iodine content is at least 3 mole%, preferably 8 mole% to 40 mole% per mole of all silver halide.

The preferred amount of silver coated on the photographic material of this invention is 1 to 20 g/m$^2$, especially 2 to 10 g/m$^2$.

Preferably, the total amount of iodine (AgI) contained in the silver halide photographic material is at least $4\times10^{-3}$ mole/m$^2$, especially $6\times10^{-3}$ mole/m$^2$ to $4\times10^{-2}$ mole/m$^2$.

A cadmium salt, a zinc salt, a lead salt, a thallium salt, an iridium salt or its complex salt, a rhodium salt or its complex salt, an iron salt or its complex salt, etc. may be present during the stage of forming silver halide grains or during physical ripening. The polymer capable of providing a cation site in a fixing solution is preferably an anion conversion polymer. Known ammonium salt (or phosphonium salt) polymers may be used as the anion conversion polymer. Ammonium salt (or phosphonium salt) polymers are widely known as mordant polymers or antistatic agent polymers.

They include, for example, the aqueous dispersion latexes described in Japanese patent application (OPI) No. 166940/84 (the term "OPI" as used herein means an "unexamined published application"), U.S. Pat. No. 3,958,995, and Japanese patent application (OPI) Nos. 142339/80, 126028/79, 155835/79, 30328/78 and 92274/79; the polyvinyl pyridinium salts described in U.S. Pat. Nos. 2,548,564, 3,148,061 and 3,756,814; the water-soluble ammonium salt polymer described in U.S. Pat. No. 3,709,690; and the water-insoluble ammonium salt polymer described in U.S. Pat. No. 3,898,088.

Preferred anion conversion polymers are represented by the following general formula (I).

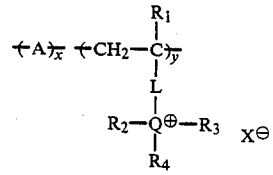

(I)

In the formula (I), A represents one or more ethylenically unsaturated monomer units. $R_1$ represents a lower alkyl group having 1 to about 6 carbon atoms or a hydrogen atom. L represents a divalent group having 1 to about 12 carbon atoms. $R_2$, $R_3$ and $R_4$ may be the same or different, and each represents a hydrogen atom, an alkyl group having 1 to about 20 carbon atoms, or an aralkyl group having 7 to about 20 carbon atoms. Alternatively, any two of $R_2$, $R_3$ and $R_4$ may be linked to one another to form a cyclic structure together with Q. Preferably, from the standpoint of residual color, only one of $R_2$, $R_3$, $R_4$ is a hydrogen atom. Q is N or P. $X^{\ominus}$ represents an anion x is 0 to about 90 mole%, and y is about 10 to 100 mole%.

Examples of the ethylenically unsaturated monomer in A include olefins such as ethylene, propylene, 1-butene, vinyl chloride, vinylidene chloride, isobutene and vinyl bromide; dienes such as butadiene, isoprene and chloroprene; ethylenically unsaturated esters of fatty acids or aromatic carboxylic acids such as vinyl acetate, allyl acetate, vinyl propionate, vinyl butyrate and vinyl benzoate; esters of ethylenically unsaturated acids such as methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, dibutyl maleate, diethyl fumarate, ethyl crotonate and dibutyl methylenemalonate; styrenes such as styrene, alphamethylstyrene, vinyltoluene, chloromethylstyrene, chlorostyrene, dichlorostyrene and bromostyrene; and unsaturated nitriles such as acrylonitrile, methacrylontrile, allyl cyanate and crotononitrile. Of these, styrenes and methacrylic esters are especially preferred from the standpoint of emulsion polymerizability and hydrophobicity. The unit A may contain two or more of the above monomers.

From the standpoint of polymerization reactivity, etc., $R_1$ is preferably a hydrogen atom or a methyl group.

L is preferably a divalent group represented by

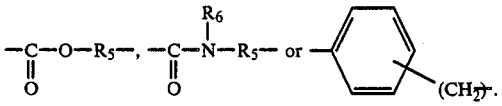

From the standpoint of alkali resistance,

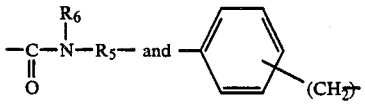

are more preferred. In particular,

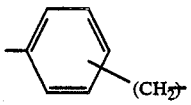

is preferred from the standpoint of emulsion polymerizability, etc. In the above formulae, $R_5$ represents an alkylene group such as a methylene, ethylene, trimethylene, or tetramethylene group, an arylene group, or an aralkylene group, for example, a group represented by the formula

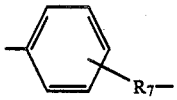

in which $R_7$ represents an alkylene group having 0 to about 6 carbon atoms; $R_6$ represents a hydrogen atom or a group selected from the groups defining $R_2$; and n is an integer of 1 or 2.

Q is preferably N from the standpoint of the toxicity of the starting material.

$X^{\ominus}$ is an anion, for example, a halogen ion such as a chlorine or bromine ion, an alkylsulfate ion such as a methylsulfate or ethylsulfate ion, an alkyl or arylsulfonate ion such as a methanesulfonate, ethanesulfonate, benzenesulfonate or p-toluenesulfonate ion, a nitrate ion, an acetate ion and a sulfate ion. Of these, the chlorine ion, alkylsulfate ion, arylsulfonate ion and sulfate ion are particularly preferred.

The alkyl and aralkyl groups for $R_2$, $R_3$ and $R_4$ include substituted and unsubstituted alkyl and aralkyl groups.

Examples of the alkyl group include unsubstituted alkyl groups such as a methyl, ethyl, propyl, isopropyl, t-butyl, hexyl, cyclohexyl, 2-ethylhexyl or dodecyl groups, and substituted alkyl groups such as alkoxyalkyl groups (e.g., methoxymethyl, methoxybutyl, ethoxyethyl, butoxyethyl and vinyloxyethyl groups), cyanoalkyl groups (e.g., a 2-cyanoethyl or 3-cyanopropyl groups), halogenated alkyl groups (such as 2-fluoroethyl, 2-chloroethyl, and perfluoropropyl groups), alkoxycarbonylalkyl groups (e.g., an ethoxycarbonylmethyl group), an allyl group, a 2-butenyl group, and a propargyl group.

Examples of the aralkyl group include unsubstituted aralkyl groups such as benzyl, phenethyl, diphenylmethyl and naphthylmethyl groups; and substituted aralkyl groups such as alkylaralkyl groups (e.g., 4-methylbenzyl, 2,5-dimethylbenzyl, 4-isopropylbenzyl and 4-octylbenzyl groups), alkoxyaralkyl groups (e.g., 4-methoxybenzyl, 4-pentachloropropenyloxybenzyl and 4-ethoxybenzyl groups), cyanoaralkyl groups (e.g., 4-cyanobenzyl and 4-(4-cyanophenyl)benzyl groups), and halogenated aralkyl groups (e.g., 4-chlorobenzyl, 3-chlorobenzyl, 4-bromobenzyl and 4-(4-chlorophenyl)-benzyl groups).

The alkyl group preferably contains from 1 to 12 carbon atoms, and the aralkyl group preferably contains from 7 to 14 carbon atoms.

Examples of the cyclic structure formed by two of $R_2$, $R_3$ and $R_4$ linked to one another together with Q are shown below.

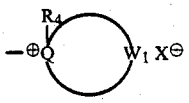

($W_1$ represents an atomic grouping required to form an aliphatic heterocyclic ring together with Q)

Preferable examples of the aliphatic heterocyclic group are as follows:

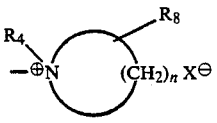

($R_8$ represents a hydrogen atom or a group selected from the groups represented by $R_4$, and n is an integer of 2 to 12)

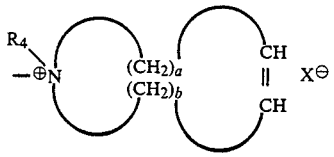

($a+b$=an integer of 2 to 7)

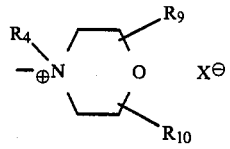

($R_9$ and $R_{10}$ represent a hydrogen atom, or an alkyl group having 1 to 6 carbon atoms)

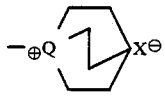

Other preferable examples include the following.

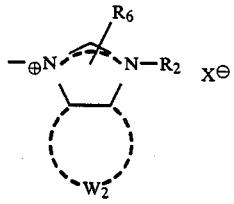

($W_2$ is non-existent, or represents an atomic group required to form a benzene ring)

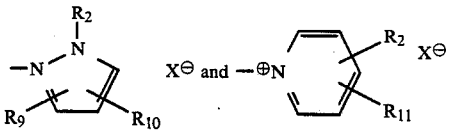

($R_{11}$ represents a hydrogen atom,

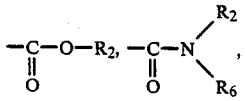

or $R_2$, when there are two $R_2$ groups, they may be identical or different)

Of these ring structures, preferred are as follows:

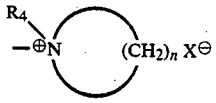

(n is an integer of 4 to 6)

and

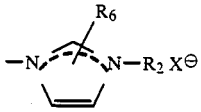

In the above examples, $R_2$, $R_4$, $R_6$, Q and $X^{\ominus}$ are as defined with regard to general formula (I).

The y component may be a mixture of two or more components.

x is preferably 20 to 60 mole%, and y is preferably 40 to 80 mole%.

Especially preferably, the above polymer is used as an aqueous crosslinked polymer latex obtained by copolymerizing a monomer having at least two, preferably 2 to 4, ethylenically unsaturated group(s) to prevent the polymer from moving from the desired layer to another layer or to a processing liquor and thus to avoid photographically deleterious effects.

A structure represented by the following general formula (II) is preferred as the structure of the aqueous crosslinked polymer latex.

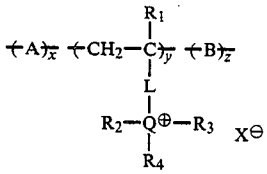

(II)

In the formula (II), A, $R_1$, $R_2$, $R_3$, $R_4$, L, Q and X are as defined with regard to general formula (I). In general formula (II), y is 10 to 99.9 mole%, preferably 10 to 95 mole%, and z is 0.1 to 50 mole%, preferably 1 to 20 mole%, and x is 0 to 90 mole%.

B represents a structural unit having copolymerized therein a copolymerizable monomer containing at least two ethylenically unsaturated groups. Examples of B include ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethyl ammonium chloride, N,N-diethyl-N-(methacryloyloxyethyl)-N-(vinylbenzyl)ammonium chloide, N,N,N',N'-tetraethyl-N,N'-bis(vinylbenzyl)-p-xylylene diammonium dichloride, N,N'-bis(vinylbenzyl)-triethylene diammonium dichloride, and N,N,N',N'-tetrabutyl-N,N'-bis(vinylbenzyl)ethylene diammonium dichloride. Among these, divinylbenzene, trivinylcyclohexane are especially preferred from the standpoint of hydrophobicity, alkali resistance, etc.

Examples of the compounds are given below.

II-1
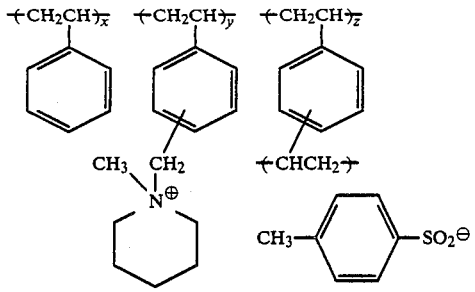
x:y:z = 47.5:47.5:5
II-2
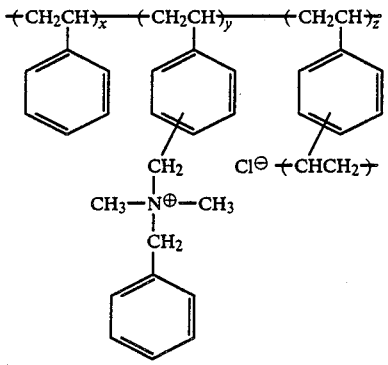
x:y:z = 45:45:10
II-3
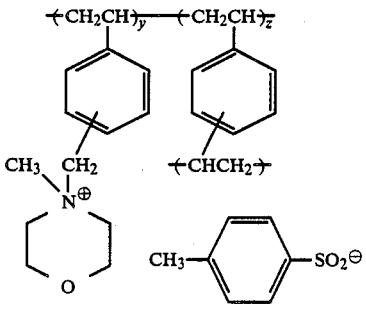
y:z = 95:5
II-4
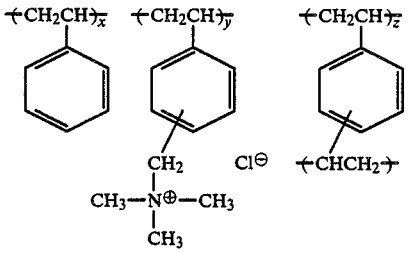
x:y:z = 45:45:10
II-5
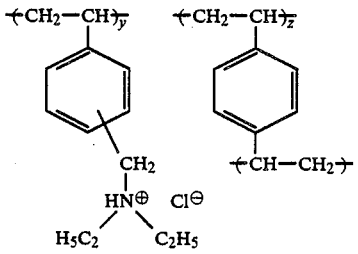
y:z = 90:10
-continued
II-6
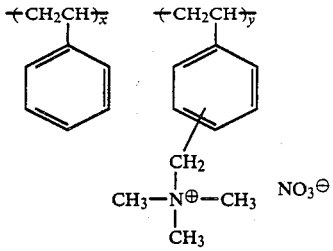
x:y = 50:50
II-7
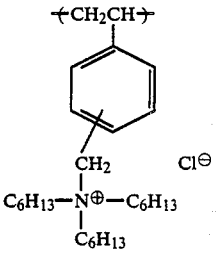
II-8
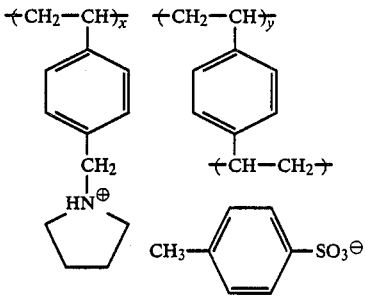
x:y = 90:10
II-9
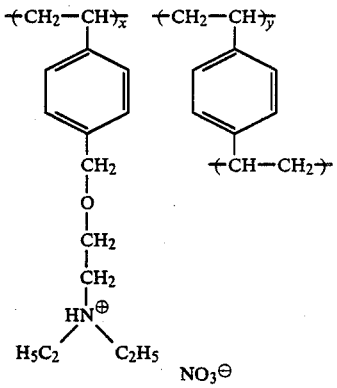
x:y = 80:20
II-10
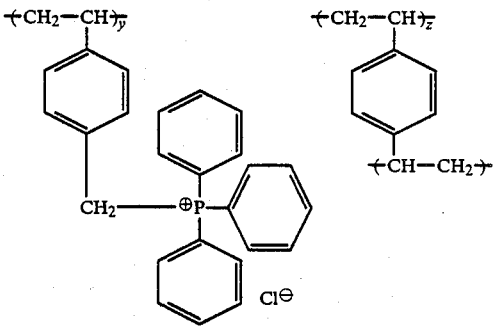
y:z = 85:15

-continued

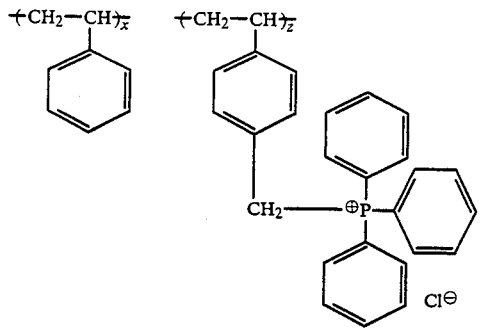

II-11 x:y = 50:50

The polymer latex has a particle diameter of 10 to 1000 nm, preferably 10 to 300 nm.

The amount of the polymer capable of providing a cation site in a fixing solution is at least 0.1, preferably 0.3 to 100, more preferably 0.5 to 30, as units of cation site per mole of the total iodine in the photograpic material.

The polymer capable of providing a cation site may be added to a photosensitive layer or a non-photosensitive layer. Preferably, it is added to a non-photosensitive layer provided between a support and a photosensitive layer. Preferred polymers capable of providing a cation site have high ability to capture an iodine ion.

Binders which can be used for the emulsion layers and other layers in the silver halide photographic material of the invention include, for example, proteins such as gelation and casein; cellulose compounds such as carboxymethyl cellulose and hydroxyethyl cellulose; sugar derivatives such as agar, dextran, sodium alginate and starch derivatives; and synthetic hydrophilic colloids such as polyvinyl alcohol, poly-N-vinylpyrrolidone, polyacrylic acid copolymers and polyacrylamides, and derivatives of partially hydrolyzed products thereof.

Gelatin, as referred to herein, denotes lime-treated gelatin, acid-treated gelatin and enzyme-treated gelatin.

The photographic material of this invention may contain the alkyl acrylate-type latexes described in U.S. Pat. Nos. 3,411,911 and 3,411,912 and Japanese Patent Publication No. 5331/70 in layer constituting the photograph material.

Preferably, the emulsion used in the photosensitive silver halide emulsion layer in this invention is chemically sensitized.

For chemical sensitization, the methods described in the above-cited books of Glafkides and Zelikman, or *Die Grundlagen der Photographischen Prozesse mit Silberhalogenidene,* edited by H. Frieser, *Akademische Verlagsgesellschaft* (1968).

Specifically, a sulfur sensitizing method using a compound containing sulfur capable of reacting with a silver ion or active gelatin, a reductive sensitizing method using a reducing substance, a noble metal sensitizing method using a compound of gold or another noble metal, etc. may be used singly or in combination. Examples of sulfur sensitizers are thiosulfates, thioureas, thiazoles, and rhodanines. Examples of reductive sensitizers that can be used include stannous salts, amines, hydrazine derivatives, formamidinesulfinic acid and silane compounds. For noble metal sensitization, gold complex salts and complex salts of metals of Group VIII of the periodic table such as platinum, iridium and palladium may be used.

Various stabilizer compounds may be included in the photographic material of this invention. They include, for example, azoles such as benzothiazolium salts, nitroindazoles, triazoles, benzotriazoles, benzimidazoles (particularly, nitro- or halogen-substituted products); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyridines; the aforesaid heterocyclic mercapto compounds which have a water-soluble salt such as a carboxyl group or a sulfonic acid group; thioketo compounds such as oxazolinethion; azaindenes such as tetrazaindenes (particularly 4-hydroxy-substituted (1,3,3a,7)tetrazaindenes); benzenesulfonic acids; and benzenesulfinic acids.

The photographic emulsion layers or other constituent layers of the photographic material of this invention may contain surface-active agents for various purposes, for example, as coating aids or for slipperiness improvement, static prevention, emulsification and dispersion, adhesion prevention and improvement of photographic characteristics (such as acceleration of development, contrast increasing or sensitization).

Examples of the surface-active agents include nonionic surface-active agents such as saponin (steroidal), alkylene oxide derivatives (such as polyethylene glycol, polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamides or amides, or polyethylene oxide adducts of silicones), glycidol derivatives (such as alkenylsuccinic acid polyglycerides, alkyl phenol polyglycerides), fatty acid esters of polyhydric alcohols, and alkyl esters of sugars; anionic surface-active agents containing an acid group such as a carboxy group, a sulfo group, a phospho group, a sulfate ester group or a phosphate ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurinic acids, sulfosuccnic acid esters sulfoalkyl polyoxyethylene alkyl phenyl esters, and polyoxyethylenealkylphosphoric acid esters; amphoteric surface-active agents such as amino acids aminoalkylsulfonic acids, aminoalkylsulfuric acids or phosphoric acid esters, alkylbetaines and amine oxides; cationic surface-active agents such as alkylamine salts, aliphatic or aromatic quaternary ammonium salts, heterocyclic quaternary ammonium salts such as pyridiniums and imidazoliums, and aliphatic or heterocycle-containing phosphonium or sulfonium salts. Of these, polyoxyethylene-type surface-active agents and fluorine-containing surface-active agents are especially preferred.

The polyoxyethylene-type surface-active agents used in this invention preferably have at least two oxyethylene groups, more preferably 2 to 100 oxyethylene groups.

Especially preferred surface-active agents of the polyoxyethylene type are those represented by the following general formulae (III-1), (III-2) and (III-3).

$$R_1-A\text{-}(CH_2CH_2O)_n\text{-}R_2 \qquad \text{(III-1)}$$

-continued (III-2)

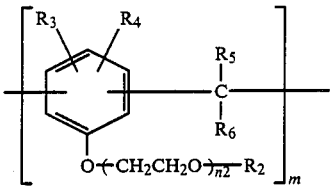

(III-3)

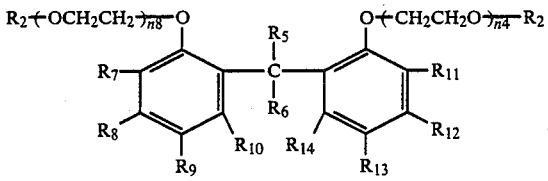

In the above formula (III-1), (III-2) and (III-3), $R_1$ represents a hydrogen atom, or a substituted or unsubstituted alkyl, alkenyl or aryl group having 1 to 30 carbon atoms.

A represents $$-O-,\ -S-,\ -COO-,\ -\underset{|}{N}-R_{15},\ -CO-\underset{|}{N}-R_{15},$$

$$\text{or } -SO_2\underset{|}{N}-R_{15}$$

(wherein $R_{15}$ represents a hydrogen atom or a substituted or unsubstituted alkyl group).

$R_2$ is the same as $R_1$ or $R_1$—A— defined hereinabove.

$R_3$, $R_4$, $R_8$, $R_{10}$, $R_{12}$ and $R_{14}$ represent a hydrogen atom, a substituted or unsubstituted alkyl group, an aryl group, an alkoxy group, a halogen atom, an acyl group, an amide group, a sulfonamide group, a carbamoyl group or a sulfamoyl group.

$R_7$, $R_9$, $R_{11}$ and $R_{13}$ represent a substituted or unsubstituted alkyl group, an aryl group, an alkoxy group, a halogen group, an acyl group, an amide group, a sulfonamide group, a carbamoyl group or a sulfamoyl group.

$R_5$ and $R_6$ represents a hydrogen atom, a substituted or unsubstituted alkyl group, an aryl group or a heterocyclic ring.

$R_5$ and $R_6$, or $R_7$ and $R_8$, or $R_9$ and $R_{10}$, or $R_{11}$ and $R_{12}$, or $R_{13}$ and $R_{14}$ may be linked to each other to form a substituted or unsubstituted ring.

n1, n2, n3 and n4 are the average degree of polymerization of ethylene oxide and is a number of 2 to 100.

m is the average degree of polymerization and is a number of 5 to 50.

Specific examples of the polyoxyethylene-type compounds in accordance with this invention are shown below.

$C_{11}H_{23}COO(CH_2CH_2O)_8H$ III-1

$C_{15}H_{31}COO(CH_2CH_2O)_{15}H$ III-2

$C_{17}H_{33}COO(CH_2CH_2O)_{15}CH_3$ III-3

$C_{18}H_{35}O(CH_2CH_2O)_{20}H$ III-4

$C_{12}H_{25}O(CH_2CH_2O)_{10}H$ III-5

$C_{16}H_{33}O(CH_2CH_2O)_{23}H$ III-6

-continued

III-7

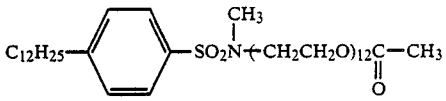

$C_{22}H_{45}O(CH_2CH_2O)_{25}H$ III-8

III-9

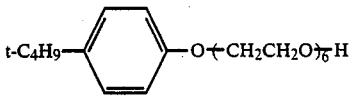

III-10

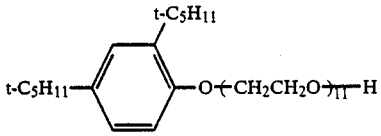

III-11

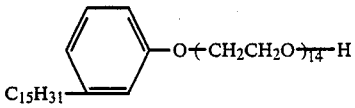

III-12

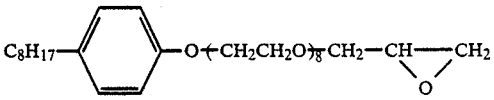

III-13

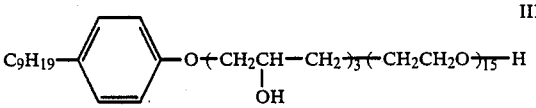

III-14

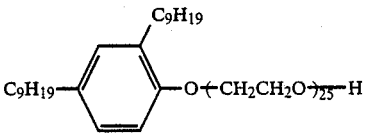

III-15

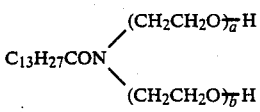

a + b = 15

III-16

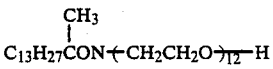

III-17

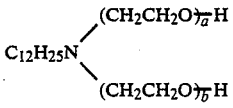

a + b = 20

$C_{12}H_{25}S(CH_2CH_2O)_{16}H$ III-18

$C_{12}H_{25}O(CH(CH_3)CH_2O)_3(CH_2CH_2O)_{15}H$ III-19

-continued

III-20

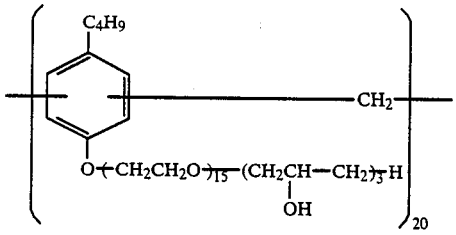

III-21

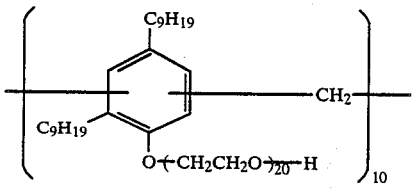

III-22

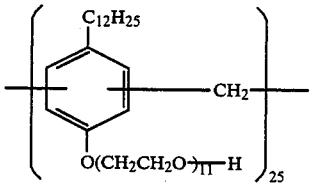

III-23

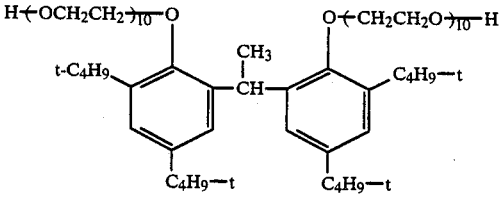

III-24

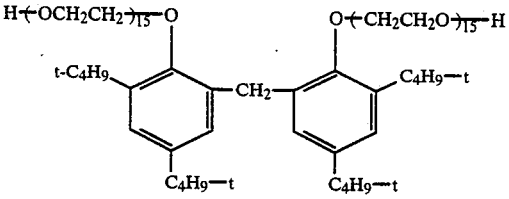

III-25

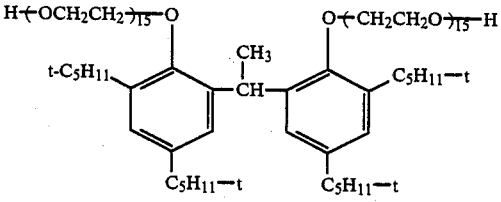

III-26

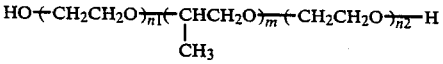

n1 + n2 = 30, m = 10

-continued

III-27

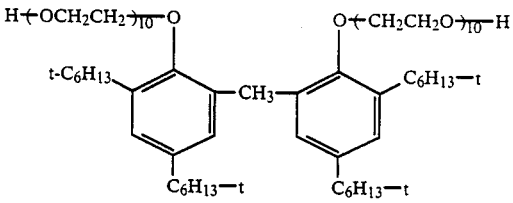

III-28

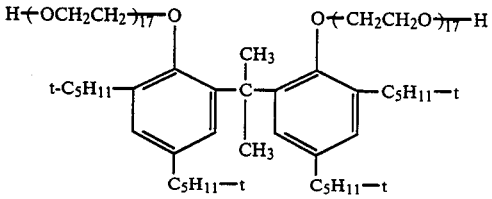

III-29

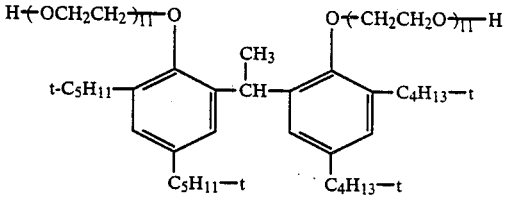

III-30

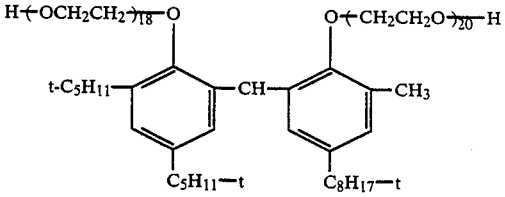

The amount of the polyoxyethylene-type surfactant used in this invention differs depending upon the type and form of the photographic material of this invention, the method of coating, etc. Generally, it is at least 6.0 mg, advantageously at least 60 mg, per mole of silver in the photographic material.

Preferably, the polyoxyethylene-type surfactant is added to the photosensitive emulsion layer of the photographic material of the invention, but may also be added to a non-photosensitive layer.

Hardening agents, such as higher-molecular-weight hardening agents having diffusion resistance as described in Japanese Patent Application (OPI) No. 142524/81, and low-molecular-weight hardening agents to be exemplified below, may be used. Typical examples include aldehyde compounds such as mucochloric acid, mucobromic acid, formaldehyde, dimethylolurea, trimethylolmelamine, glyoxal, 2,3-dihydroxy-5-methyl-1,4-dioxane and glutaraldehyde; active vinyl compounds such as divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, bis(vinylsulfonylethyl)ether, 1,3-bis(vinylsulfonyl)-2-propanol and 1,3-bis(vinylsulfonylacetylamide)propane; active halogen-containing compounds such as 2,4-dichloro-6-hydroxy-s-triazine sodium salt, 2,4-dichloro-6-methoxy-s-triazine, 2,4-dichloro-6-(4-sulfoaniline)-s-triazine sodium salt, 2,4-dichloro-6-(2-sulfoethylamino)-s-triazine and N,N'- bis(2-chloroethylcarbamyl)piperazine; epoxy compounds such as bis(2,3-epoxypropyl)methylpropyl ammonium p-toluenesulfonate; ethyleneimine-type compounds such as 2,4,6-triethyleneimino-s-triazine; methane sulfonic acid ester compounds such as 1,2-di(methanesulfonoxy)ethane; carbodiimide-type compounds such as dicyclohexylcarbodiimide; isoxazole-type compounds such as 2,5-dimethylisoxazole perchlorate; and inorganic compounds such as chromium alum and chromium acetate.

Of these, compounds having a vinylsulfone group and active halogen compounds are especially preferred.

The photographic emulsion of this invention may be spectrally sensitized with methine dyes and other dyes. Dyes used include, for example, cyanine dyes, merocyanine dyes, compound cyanine dyes, compound merocyanine dyes, holopolar cyanine dyes, hemicyanine dyes, styryl dyes and hemioxonol dyes. Cyanine dyes, merocyanine dyes and compound merocyanine dyes are especially useful. These dyes may contain any of the rings which are usually utilized in the cyanine dyes as basic heterocyclic rings. Examples of such basic heterocyclic rings are pyrroline, oxazoline, thiazoline, pyrrole, oxazole, thiazole, selenazole, imidazole, tetrazole and pyridine rings; rings resulting from fusion of alicyclic hydrocarbon rings benzoxazole, naphthoxazole, benzothiazole, naphthothiazole, benzoselenazole, benzimidazole and quinoline rings. These rings may be substituted on a carbon atom.

The merocyanine dyes or compound merocyanine dyes may contain 5- or 6-membered heterocyclic rings such as pyrazolin-5-one, thiohydantoin, 2-thiooxazolidine-2,4-dione, thiazolidine-2,4-dione, rhodanine and thiobarbituric acid rings as rings having a ketomethylene structure.

The amount of the sensitizing dyes used in this invention is preferably $1\times10^{-6}$ to $5\times10^{-3}$ mole per mole of silver.

The photographic emulsion used in this invention may contain a color image-forming coupler, i.e., a compound which forms a dyes by reaction with the oxidation product of an aromatic amine (usually primary amines) developing agent (to be abbreviated as the coupler). Desirably, the coupler has a hydrophobic group, called a ballast group, in the molecule and is non-diffusible. The coupler may be tetra-equivalent or di-equivalent to the silver ion. It may contain a colored coupler imparting a color correction effect or a coupler releasing a developer inhibitor upon development (so-called DIR coupler). The coupler may also be such that the product of the coupling reaction is colorless.

Known closed-chain ketomethylene-type couplers may be used as a yellow-forming coupler. Benzoyl acetanilide-type and pivaloyl acetanilide-type compounds are advantageous.

Pyrazolone compounds, indazolone-type compounds, cyanoacetyl compounds, etc. may be used as magenta couplers. The pyrazolone compounds are especially advantageous.

Phenolic compounds and naphtholic compounds may be used as cyan couplers.

A protective layer in the silver halide photographic material of this invention is composed of a hydrophilic colloid. Examples of hydrophilic colloids may be the same as those described hereinabove. The protective layer may be single-layered or multi-layered.

Preferably, a matting agent and/or a smoothening agent may be added to the emulsion layer or the protective layer in the silver halide photographic material of this invention. Examples of preferred matting agents are organic compounds, for example, water-dispersible vinyl polymers such as polymethyl methacrylate having a suitable particle diameter (0.3 to 5 microns of a diameter, or at least 2 times, particularly 4 times, as large as the thickness of the protective layer), and inorganic compounds such as silver halides and strontium barium sulfate. The smoothening agent is useful for preventing adhesion troubles as is the case with the matting agent, and are also effective for improving frictional characteristics which have to do with camera adaptability at the time of photographing or projecting motion picture films. Specific examples of preferred smoothening agents include liquid paraffins, waxes such as higher fatty acid esters, polyfluorinated hydrocarbons or derivatives thereof, and silicones such as polyalkylpolysiloxanes, polyarylpolysiloxanes, polyalkylarylpolysiloxanes, or alkylene oxide adducts of these.

As required, an interlayer, a filter layer, etc. may be formed on the silver halide photographic material of this invention.

Examples of the silver halide photographic material of the invention include a radiographic material, a lithographic material, a black-white photographic material, a color negative photographic material, a color reversal photographic material and a color paper. The negative photographic material is preferred.

As required, various additives may be used in the photographic material of this invention. Examples include a development accelerator, a fluorescent bleaching agent, a color antifoggant, and an ultraviolet absorber. Specific examples of these additives are disclosed, for example, in *Research Disclosure,* No. 176, pages 28 to 30 (RD-17643, 1978).

For development of the photographic material of this invention, the description at pages 28 to 30 of RD-17643 may be referred to, the disclosure of which is incorporated herein by reference.

Fixing agents which are used for the fixing bath in this invention include thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; and water-soluble silver halide dissolving agents such as thioureas, etc. They can be used singly or as a mixture thereof. Also, a combination of the fixing agent and a halide such as potassium iodide described in Japanese Patent Application (OPI) No. 155354/80 can be used in this invention. The use of a thiosulfate, in particular, ammonium thiosulfate is preferred.

The amount of the fixing agent is preferably from about 0.3 mol to 3 mol, and more preferably from about 0.5 mol to 2.0 mol, per liter of processing solution.

The pH range of the fix solution in this invention is preferably about 3 to 10, and more preferably from about 4 to 9. If the pH is lower than this range, the deterioration of the liquid is accelerated.

For controlling the pH of the fix solution, if necessary, hydrochloric acid, sulfuric acid, nitric acid, acetic acid, hydrogencarbonates, ammonia, potassium hydroxide, sodium hydroxide, sodium carbonate, potassium carbonate, etc., may be added to the liquid.

Examples of the fixing solution for processing the photographic material include Fujifix, Super Fujifix, Fuji DP Fix and Super Fuji Fix DP made by Fuji Photo Film Co., Ltd.; F-6, Kodak Fixer made by Eastman Kodak Co.; Konifix, Konifix Rapid made by Konishiroku Photographic Co., Ltd.; and other fixing solutions available under the tradenames Olifix, Myfix, Niwafix, Nissan Rapid Fixer F, Nissan Rapid Fixer P, Panfix F, Panfix P, Myrol F and Oriental QF.

The following Examples illustrate the present invention more specifically without any intention of limiting the invention thereby. Unless otherwise indicated, all parts, percents, ratios and the like are by weight.

EXAMPLE 1

(1) Preparation of silver halide photographic emulsions

Potassium bromide, potassium iodide and silver nitrate were added to an aqueous solution of gelatin with vigorous stirring to prepare thick plate-like silver iodobromide (average iodine content 4 mole%) having an average grain diameter of 1 micron. Thereafter, the silver iodobromide was rinsed by an ordinary precipitation method, and then chemically sensitized by a gold-sulfuric acid sensitizing method using chloroauric acid and sodium thiosulfate to prepare a photosensitive silver iodobromide emulsion A. Silver halide emulsions B (average iodine content 8 mole%) and C (average iodine content 13 mole%) were prepared in the same way as in the preparation of the silver halide emulsion A except that the amount of potassium iodide was altered. A silver halide emulsion D (average iodine content 0 mole%) was prepared as above except using no potassium iodide.

(2) Preparation of coated samples

Samples 1 to 12 were prepared by successively providing layers of the following formulations on a triacetyl cellulose support from the support side.

| | |
|---|---|
| Lowermost Layer | |
| Binder: gelatin | 1 g/m$^2$ |
| Fixation accelerator: | |
| E-1 | |

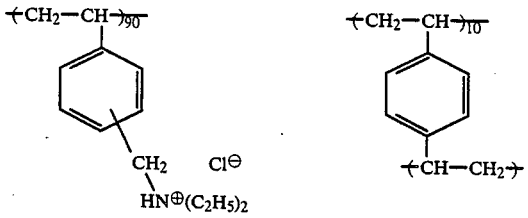

| | |
|---|---|
| Emulsion Layer | |
| Amount of silver coated: | 5.5 g/m$^2$ |
| Binder: gelatin | 1.6 g/l g of Ag |
| Sensitizing dye: | |
| Dye-1 | 2./mg/Ag/g |

-continued

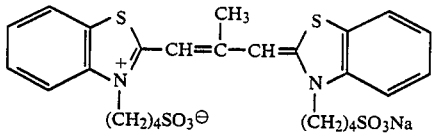

| | |
|---|---|
| Additive: | |
| $C_{18}H_{35}O(CH_2CH_2O)_{20}H$ | 5.8 mg/l g of Ag |
| Coating aids: | |
| sodium dodecylbenzenesulfonate | 0.1 mg/m$^2$ |
| poly(potassium p-styrenesulfonate) | 1 mg/m$^2$ |
| Surface Protecting Layer | |
| Binder: gelatin | 0.7 g/m$^2$ |
| Coating agent: | |
| sodium N—oleoyl-N—methyltaurate | 0.2 mg/m$^2$ |
| Matting agent: | |
| fine particles (average size 3 microns) of polymethylmethacrylate | 0.13 mg/m$^2$ |

(3) Sensitometry

These samples were each stored at a temperature of 25° C. and a relative humidity of 65% for 7 days after coating. Then, they were each developed at 20° C. for 7 minutes with a developer of the following formulation, and fixed with fixing solution 1 shown below, rinsed and dried. Then, the granularities of these developed samples were measured.

Furthermore, the fixation termination time in the fixing solution 1 was measured.

(a) Measurement of granularity

Granularity was rms granularity (at the part having an optical density of 0.8) with an aperture diameter of 48 microns. The rms granularity is described at pages 619–620 of *The Theory of the Photographic Process* edited by T. H. James, Macmillan, (1977).

(b) Measurement of the fixation termination time

The fixing time was varied, and the transmittance of each sample after drying was measured by a spectrophotometer. The time at which the transmittance was substantially 100% for a non-exposed area of a negative working emulsion was defined as the fixation termination time.

| | |
|---|---|
| Developer | |
| Metal | 2 g |
| Sodium sulfate | 100 g |
| Hydroquinone | 5 g |
| Borax.10$H_2O$ | 2 g |
| Water to make | 1 liter |
| Fixing solution 1: | |
| $Na_2S_2O_3$ | 240 g |
| Sodium sulfate | 15 g |
| Acetic acid (28%) | 48 ml |
| Potash alum | 15 g |
| Boric acid | 4 g |
| Water to make | 1 liter |

adjusted pH to be 4.9 with NaOH or sulfuric acid

TABLE 1

| Sample | Emulsion | Average Iodine Content (mole %) | Amount of Iodine (mole/m$^2$) | Fixation Accelerator (units/m$^2$) | Fixation Termination Time (seconds) | Granularity (RMS) |
|---|---|---|---|---|---|---|
| 1 | A | 4 | $2.0 \times 10^{-3}$ | 0 | 39 | 0.032 |
| 2 | " | " | " | $0.6 \times 10^{-3}$ | 36 | 0.032 |
| 3 | " | " | " | $6 \times 10^{-3}$ | 30 | 0.032 |

TABLE 1-continued

| Sample | Emulsion | Average Iodine Content (mole %) | Amount of Iodine (mole/m$^2$) | Fixation Accelerator (units/m$^2$) | Fixation Termination Time (seconds) | Granularity (RMS) |
|---|---|---|---|---|---|---|
| 4 | B | 8 | $4.1 \times 10^{-3}$ | 0 | 90 | 0.02 |
| 5 | " | " | " | $0.6 \times 10^{-3}$ | 50 | 0.02 |
| 6 | " | " | " | $6 \times 10^{-3}$ | 32 | 0.02 |
| 7 | C | 13 | $6.6 \times 10^{-3}$ | 0 | 120 | 0.012 |
| 8 | " | " | " | $0.6 \times 10^{-3}$ | 100 | 0.012 |
| 9 | " | " | " | $6 \times 10^{-3}$ | 63 | 0.012 |
| 10 | D | 0 | 0 | 0 | 30 | 0.04 |
| 11 | " | " | " | $0.6 \times 10^{-3}$ | 29 | 0.04 |
| 12 | " | " | " | $6 \times 10^{-3}$ | 26 | 0.04 |

As is seen from Table 1, granularity becomes better when the average iodine content is increased, but the fixation termination time increases. The use of the fixation accelerator in accordance with this invention makes the termination time very short. This effect is remarkable as the amount of iodine increases beyond $4 \times 10^{-3}$ mole/m$^2$.

EXAMPLE 2

Coated samples 13 to 20 were prepared as above but with mixing the emulsions A to D described in Example 1 in the proportions set forth in Table 2.

The layer construction was the same as in Example 1, but the following dyes were added to the lowermost layer.

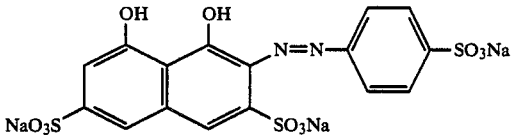

$1 \times 10^{-3}$ mole/m$^2$

-continued

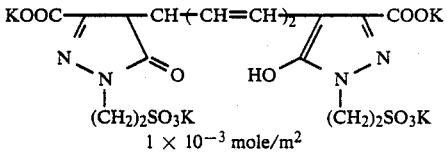

$1 \times 10^{-3}$ mole/m$^2$

Sensitometry and the measurement of the fixation termination time were effected as in Example 1. The fixing solution 1 was used.

TABLE 2

| Sample | Emulsion | Average Iodine Content (mole %) | Amount of Iodine (mole/m$^2$) | Fixation Accelerator (units/m$^2$) | Fixation Termination Time (seconds) |
|---|---|---|---|---|---|
| 13 | A + B (1:1) | 6 | $3.1 \times 10^{-3}$ | $6.2 \times 10^{-3}$ | 51 |
| 14 | " | " | " | 0 | 63 |
| 15 | B + C (1:2) | 11.3 | $5.8 \times 10^{-3}$ | $11.6 \times 10^{-3}$ | 72 |
| 16 | " | " | " | 0 | 116 |
| 17 | C + D (8:5) | 8 | $4 \times 10^{-3}$ | $8 \times 10^{-3}$ | 69 |
| 18 | " | " | " | 0 | 90 |
| 19 | A + D (1:1) | 2 | $1.0 \times 10^{-3}$ | $2 \times 10^{-3}$ | 35 |
| 20 | " | " | " | 0 | 36 |

Note:
The parenthesized figures in the column of "Emulsion" denote mixing ratios.

As can be seen from the data shown in Table 2, for the mixtures of the silver halide grains, the effect of the fixation accelerator becomes remarkable as the total porportion of iodine in the grains increases.

EXAMPLE 3

(1) Silver halide emulsion

Emulsion B in Example 1 was used.

(2) Preparation of coated samples

Samples 21 to 30 were prepared by successively providing layers of the following formulations on a triacetylcellulose support from the support side.

Emulsion Layer

Amount of silver coated: described in Table 3.

Binder: gelatin — 8.8 g/m$^2$

Sensitizing dye: — 2.5 mg/l g of Ag

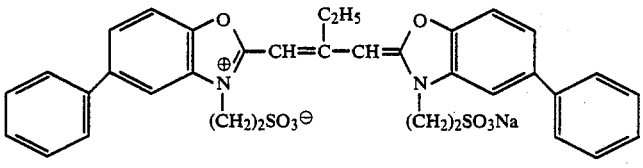

Additive: $C_{18}H_{35}O(CH_2CH_2O)_{20}H$ — 5.5 mg/l g of Ag

-continued

| Surface Protective Layer | |
|---|---|
| Binder: gelatin | 1.2 g/m$^2$ |
| Fixation accelerator | |

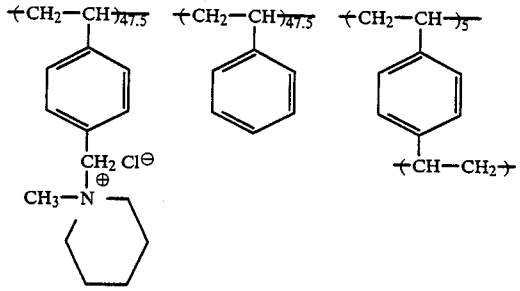

| | |
|---|---|
| Matting agent: fine particles (average size 3 microns) of polymethyl methacrylate | 0.13 mg/m$^2$ |
| Hardening agent: 1,2-bis(vinylsulfonylacetamide)-ethane | $1.05 \times 10^{-4}$ mole/m$^2$ |

TABLE 3

| Sample | Emulsion | Average Iodine Content (mole %) | Amount of Silver Coated (g/m$^2$) | Amount of Iodine (mole/m$^2$) | Fixation Accelerator (units/m$^2$) | Fixation Termination Time (seconds) |
|---|---|---|---|---|---|---|
| 21 | B | 8 | 2.7 | $2 \times 10^{-3}$ | 0 | 31 |
| 22 | " | " | " | " | $4 \times 10^{-3}$ | 29 |
| 23 | " | " | 4.05 | $3 \times 10^{-3}$ | 0 | 52 |
| 24 | " | " | " | " | $6 \times 10^{-3}$ | 40 |
| 25 | " | " | 5.4 | $4 \times 10^{-3}$ | 0 | 109 |
| 26 | " | " | " | " | $8 \times 10^{-3}$ | 37 |
| 27 | " | " | 6.75 | $5 \times 10^{-3}$ | 0 | 163 |
| 28 | " | " | " | " | $1 \times 10^{-2}$ | 60 |
| 29 | " | " | " | " | $2 \times 10^{-2}$ | 49 |
| 30 | " | " | " | " | $3 \times 10^{-2}$ | 46 |

The effect of the fixation accelerator is evident from Table 3.

EXAMPLE 4

(1) Silver halide emulsions

Emulsions B and C of Example 1 were used.

(2) Preparation of coated samples

Coated samples 31 to 37 were prepared by successively providing layers of the following formulations on a triacetyl cellulose support from the support side.

| Emulsion Layer-1 | |
|---|---|
| Amount of silver coated: (emulsion B) | 2 g/m$^2$ |
| Binder: gelatin | 1.6 g/1 g of Ag |
| Sensitizing dye: Dye-1 | 2.1 mg/1 g of Ag |
| Additive: $C_{18}H_{35}O(CH_2CH_2O)_{20}H$ | 5.8 mg/1 g of Ag |
| Fixation accelerator: described in Table 4. | |
| **Emulsion Layer-2** | |
| Amount of silver coated: (emulsion C) | 4.5 g/m$^2$ |
| Binder: gelatin | 1.0 g/1 g of Ag |
| Sensitizing dye: Dye-1 | 2.1 mg/1 g of Ag |
| Additive: $C_{18}H_{35}O(CH_2CH_2O)_{20}H$ | 5.8 mg/1 g of Ag |
| Fixation accelerator: described in Table 4. | |

-continued

| Surface Protecting Layer | |
|---|---|
| Binder: gelatin | 0.7 g/m$^2$ |
| Matting agent: fine particles (average size: 3 microns) of polymethyl methacrylate | 0.13 mg/m$^2$ |

(3) Sensitometry

The fixation termination time was measured as in Example 1. The following fixing solution 2 was used as a fixing solution.

| Fixing solution 2 | |
|---|---|
| $(NH_4)_2S_2O_3$ | 140 g |
| $Na_2S_2O_3.5H_2O$ | 40 g |
| Sodium sulfate | 20 g |
| $H_3BO_3$ | 6 g |
| KI | 0.5 g |
| Acetic acid (28%) | 42 ml |
| Potash alum | 26 g |
| Water to make | 1 liter |
| pH (adjusted with NaOH or sulfuric acid) | 4.8 |

TABLE 4

| Sample | Emulsion Layer-1 Fixation Accelerator | Emulsion Layer-1 Amount (units/m$^2$) | Emulsion Layer-2 Fixation Accelerator | Emulsion Layer-2 Amount (units/m$^2$) | Fixation Termination Time (seconds) |
|---|---|---|---|---|---|
| 31 | — | 0 | — | 0 | 36 |
| 32 | E-1 | $1.5 \times 10^{-3}$ | E-1 | $5.4 \times 10^{-3}$ | 19 |
| 33 | " | $3 \times 10^{-3}$ | " | $10.8 \times 10^{-3}$ | 13 |
| 34 | " | $6.9 \times 10^{-3}$ | — | 0 | 19 |

TABLE 4-continued

| Sample | Emulsion Layer-1 Fixation Accelerator | Emulsion Layer-1 Amount (units/m$^2$) | Emulsion Layer-2 Fixation Accelerator | Emulsion Layer-2 Amount (units/m$^2$) | Fixation Termination Time (seconds) |
|---|---|---|---|---|---|
| 35 | " | $13.8 \times 10^{-3}$ | — | 0 | 13 |
| 36 | E-2 | $6.9 \times 10^{-3}$ | — | 0 | 29 |
| 37 | " | $13.8 \times 10^{-3}$ | — | 0 | 19 |

Each of the samples had a swelling ratio of 180%.

Swelling ratio: $(D_2-D_1)/D_1 \times 100\%$ $D_1$: the total film thickness when the film is dry $D_2$: film thickness after the film was immersed in distilled water at 20° C. for 5 minutes E-1: crosslinked latex E-2: 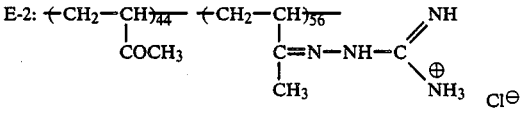

(not a latex)

It is seen from Table 4 that the fixing accelerator was effective also in fixing solutions of the fixing solution 2.

Probably because of diffusion in the developer, E-2 which is not a latex, was less effective than E-1 which is a latex.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one photosensitive silver halide emulsion layer containing photosensitive silver halide grains, said silver halide grains having average iodine content of from 3 to 40 mol%, and said photographic material further containing a polymer capable of providing a cation site in a fixing solution on the same side as the emulsion layer, wherein said polymer is present in said photographic material in an amount from 0.1 to 100 units of cation sites per mol of the total iodine in said photographic material.

2. The photographic material of claim 1 wherein the silver halide grains have an average iodine content of from 8 to 40 mol%.

3. The photographic material of claim 1 wherein the amount of silver halide coated is at least $4 \times 10^{-3}$ mole/m$^2$.

4. The photographic material of claim 1 wherein the polymer capable of providing a cation site in a fixing solution is a polymer represented by the following general formula (I)

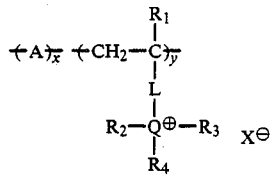

(I)

wherein A represents a unit of an ethylenically unsaturated monomer; L represents a divalent group having 1 to about 12 carbon atoms; $R_1$ represents a hydrogen atom or an alkyl group having 1 to about 6 carbon atoms; $R_2$, $R_3$ and $R_4$ are identical or different and each represents an alkyl group having 1 to about 20 carbon atoms, an aralkyl group having 7 to about 20 carbon atoms, or a hydrogen atom, or two of $R_2$, $R_3$ and $R_4$ may be linked to one another to form a cyclic structure together with Q; Q is N or P; $X^{\ominus}$ represents an anion; x is 0 to about 90 mole%; and y is about 10 to 100 mole%.

5. The photographic material of claim 1 wherein the polymer capable of providing a cation site in a fixing solution is a crosslinked polymer latex represented by the following general formula (II)

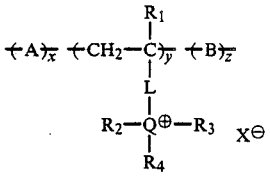

(II)

wherein A represents a unit of an ethylenically unsaturated monomer; B represents a structural unit having copolymerized therein a copolymerizable monomer having at least two ethylenically unsaturated groups; L represents a divalent group having 1 to about 12 carbon atoms; $X^{\ominus}$ represents an anion; $R_1$ represents a hydrogen atom or an alkyl group having 1 to about 6 carbon atoms; $R_2$, $R_3$ and $R_4$ are the same or different and each represents an alkyl group having 1 to about 20 carbon atoms, an aralkyl group having 7 to about 20 carbon atoms, or a hydrogen atom, or two of $R_2$, $R_3$ and $R_4$ may be linked to one another to form a cyclic structure together with Q; Q is N or P; x is 0 to about 90 mole%; y is 10 to 99.9 mole%; and z is 0.1 to 50 mole%.

6. The photographic material of claim 4 wherein only one of $R_2$, $R_3$ and $R_4$ in formula (I) is a hydrogen atom.

7. The photographic material of claim 5 wherein only one of $R_2$, $R_3$ and $R_4$ in formula (II) is a hydrogen atom.

8. The photographic material of claim 1 which further comprises a surface-active agent.

9. The photographic material of claim 8 wherein the surface-active agent is a polyoxyethylene-type surface-active agent.

10. The photographic material as in claim 1, wherein said silver halide emulsion layer contains a mix of iodine-containing grains and non-iodine-containing grains and the iodine content is at least 3 mole% of all silver halide in said emulsion layer.

* * * * *